US007422217B2

(12) United States Patent
Hinnant

(10) Patent No.: US 7,422,217 B2
(45) Date of Patent: Sep. 9, 2008

(54) TARGET ASSEMBLY FOR HOLDING CLAY TARGETS

(76) Inventor: Kenneth A. Hinnant, 5715 Hwy. 581, Kenly, NC (US) 27542

( * ) Notice: Subject to any disclaimer, the term of this patent is extended or adjusted under 35 U.S.C. 154(b) by 310 days.

(21) Appl. No.: 11/179,268

(22) Filed: Jul. 12, 2005

(65) Prior Publication Data

US 2007/0013138 A1 Jan. 18, 2007

(51) Int. Cl.
*F41J 1/10* (2006.01)

(52) U.S. Cl. ..... 273/407

(58) Field of Classification Search ..... 273/403–410, 273/380; 206/562, 563, 476, 482, 483, 782, 206/783, 557; 229/108, 108.1, 112
See application file for complete search history.

(56) References Cited

U.S. PATENT DOCUMENTS

| | | | | | |
|---|---|---|---|---|---|
| 2,355,206 | A * | 8/1944 | Davidson, Jr. | ..... | 206/562 |
| 2,808,189 | A * | 10/1957 | Williams | ..... | 206/592 |
| 3,088,738 | A | 5/1963 | Meyer | | |
| 3,450,406 | A * | 6/1969 | Brown | ..... | 473/83 |
| 3,756,499 | A * | 9/1973 | Giebel et al. | ..... | 229/117.17 |
| 3,899,119 | A * | 8/1975 | Roccaforte | ..... | 206/562 |
| 4,022,472 | A | 5/1977 | Seals | | |
| 4,053,101 | A * | 10/1977 | Hart, Jr. | ..... | 206/736 |
| 4,244,509 | A * | 1/1981 | Dlugopolski | ..... | 206/509 |
| 4,350,281 | A * | 9/1982 | Dornbusch et al. | ..... | 206/774 |
| 4,353,496 | A * | 10/1982 | Nelson, Jr. et al. | ..... | 229/178 |
| 5,280,920 | A | 1/1994 | Knapper, II | | |
| 5,301,871 | A * | 4/1994 | Gross et al. | ..... | 206/562 |
| D382,599 | S | 8/1997 | Starrett | | |
| 6,244,598 | B1 | 6/2001 | Conville | | |
| 6,523,693 | B1 * | 2/2003 | Eggenberger et al. | ..... | 206/760 |
| 6,755,711 | B2 | 6/2004 | McClung et al. | | |
| 6,780,014 | B1 | 8/2004 | Hull et al. | | |
| 6,793,070 | B2 * | 9/2004 | Dye | ..... | 206/45.24 |
| 6,913,263 | B2 * | 7/2005 | Fort, II | ..... | 273/406 |
| 2006/0220318 | A1 * | 10/2006 | Law | ..... | 273/407 |

* cited by examiner

*Primary Examiner*—Mark S Graham
(74) *Attorney, Agent, or Firm*—Coats & Bennett, P.L.L.C.

(57) ABSTRACT

A target assembly is provided for holding clay targets immobile. The assembly is comprised of a support member and one or more cutouts in the support member for frictionally holding clay targets.

21 Claims, 9 Drawing Sheets

TARGET ASSEMBLY FOR HOLDING CLAY TARGETS

FIELD OF INVENTION

This invention relates to a target assembly for holding clay targets.

BACKGROUND OF INVENTION

There are countless products on the market for target practice and/or sight checks. These products are often expensive, cumbersome, and/or complex. Nearly all conventional products fail to provide sufficient visual confirmation of a hit from a great distance. A superior marksman may fire two shots at a target from a great distance, find one hole in the target, and be unable to discern whether the second shot followed the first or went astray. Therefore, there has been, and continues to be, a need for a product to overcome these deficiencies.

SUMMARY OF THE INVENTION

The present invention entails a target assembly in which clay targets are held immobile. The assembly includes a support member having one or more cutouts. Clay targets can be inserted into the cutouts and frictionally held immobile. In one embodiment of the invention, the target assembly is made of a planar support member, which has a front side and a back side. A printed target is disposed on the front side, and there are one or more cutouts on the back side for frictionally holding clay targets. The support member is collapsible, foldable, and self-supporting.

DESCRIPTION OF EXEMPLARY EMBODIMENT

With further reference to the drawings, one embodiment of the target assembly of the present invention is shown therein and indicated generally by the number 10. As will be appreciated from other portions of the disclosure, the target assembly 10 is adapted to be used to hold clay targets for target practice or sighting. The embodiment addressed herein is collapsible, foldable, and self-supporting.

Target assembly 10 may be constructed of various sheet materials, but it is contemplated that in one embodiment it would be constructed of cardboard. Plastic materials could also be used. The embodiment herein illustrated is formed from a single piece of cardboard by stamping. Other fabrication methods could be used. The thickness or gauge of the material utilized for the target assembly 10 can vary to suit various types of applications.

Figure 1:
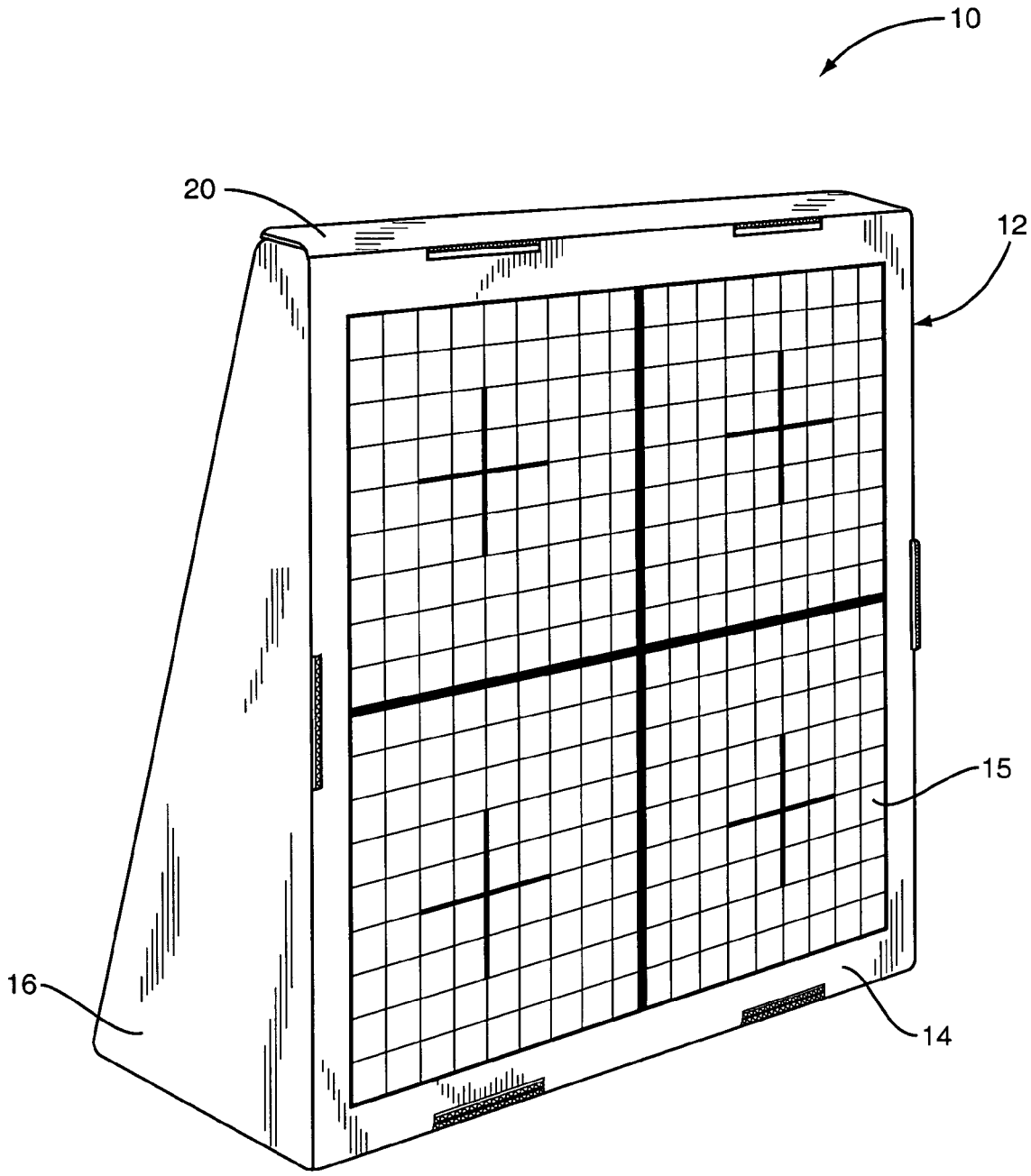
FIG. 1 is a front view of one exemplary embodiment.
Figure 2:
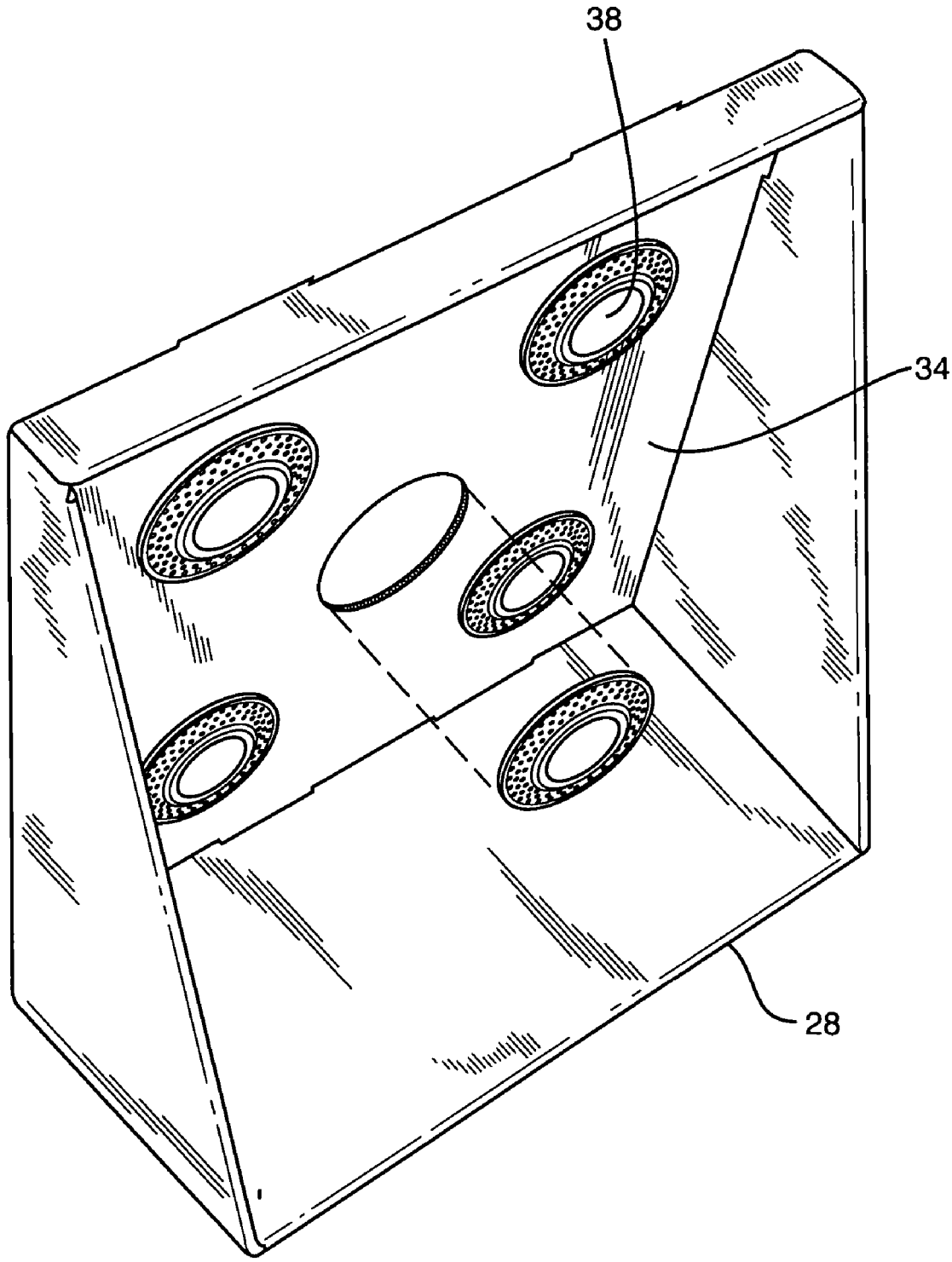
FIG. 2 is a back view of one exemplary embodiment.

Turning to FIGS. 1 and 2, the target assembly 10 is pictured. FIG. 1 shows a perspective of the erected target assembly 10 from the front. FIG. 2 shows a perspective of the erected target assembly 10 from the back. The target assembly 10 is comprised of a support member 12 having six parts: a front panel 14, two side panels 16, a top panel 24, a bottom panel 28, and a back panel 34. A printed target 15 is disposed on said front panel 14. The printed target 15 may be printed directly onto the front panel 14. In the alternative, said printed target 15 may be printed on a separate sheet and attached to the front panel 14 by any number of means. For example, the printed target 15 could be adhered to the front panel 14 using an adhesive. The front panel 14 may also be formed with tabs to engage the edges of the printed target 15. In this case, the printed target 15 is replaceable. Also, the printed target 15 could be attached to the front panel by thumb tacks. The back panel 34 has cutouts to receive clay targets 38.

Figure 3:
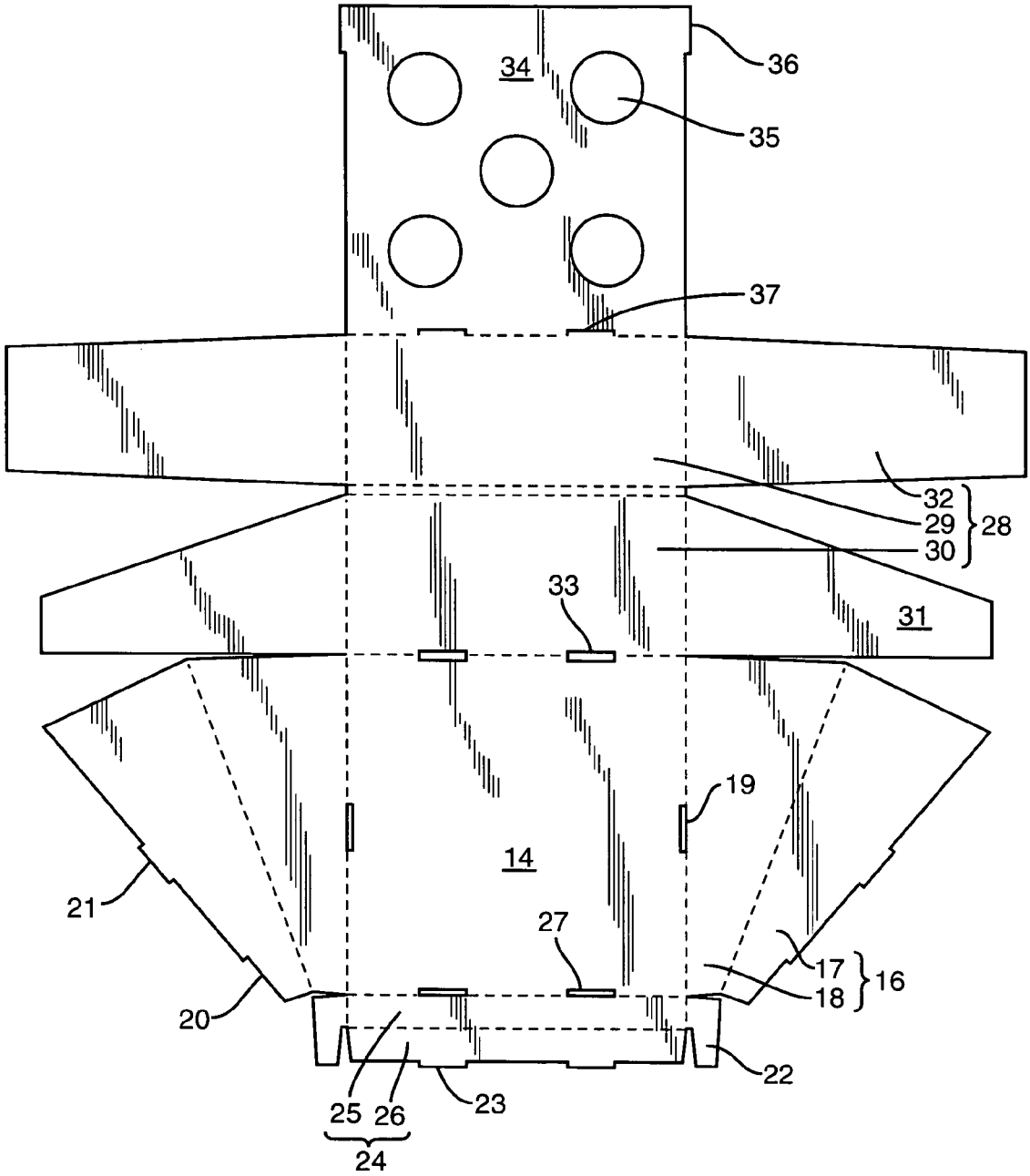
FIG. 3 is a perspective view showing one embodiment in its collapsed form.

FIG. 3 shows the target assembly 10 laid flat prior to assembly. As shown in FIG. 3, the bottom panel 28 is comprised of an upper bottom panel layer 29 and a lower bottom panel layer 30. Attached to either side of the upper bottom panel layer 29 are reinforcing panels 32. Two side flaps 31 are attached to either side of the lower bottom panel layer 30. A back panel 34 is attached to the edge of the upper bottom panel layer 29 opposite lower bottom panel layer 30. The back panel 34 has a plurality of cutouts 35 and locking tabs 36. A front panel 14 is attached to lower bottom panel layer 30. There are two slots 33 between the front panel 14 and the lower bottom panel layer 30. Attached on opposing sides of front panel 14 are side panels 16, with a slot 19 on either side of the front panel 14 where side panels 16 attach. Side panels 16 are each comprised of an inner side panel layer 17 and an outer side panel layer 18. The inner side panel layer 17 has a locking tab 21 at about the halfway point. Notches 20 are cut into the top edges of the inner side panel layers 17. The inner side panel layers 17 and outer side panel layers 18 are designed to fold against one another. A top panel 24 is comprised of an upper top panel layer 25 and lower top panel layer 26. The upper top panel layer 25 is attached to the front panel 14 opposite the lower bottom panel layer 30. There are two slots 27 at the point of attachment for the upper top panel layer 25 and the front panel 14. There are two locking tabs 23 on the lower top panel layer 26 opposite its connection with the upper top panel layer 25. Two flaps 22 are connected to the top of outer side panel layers 18.

Figure 4:
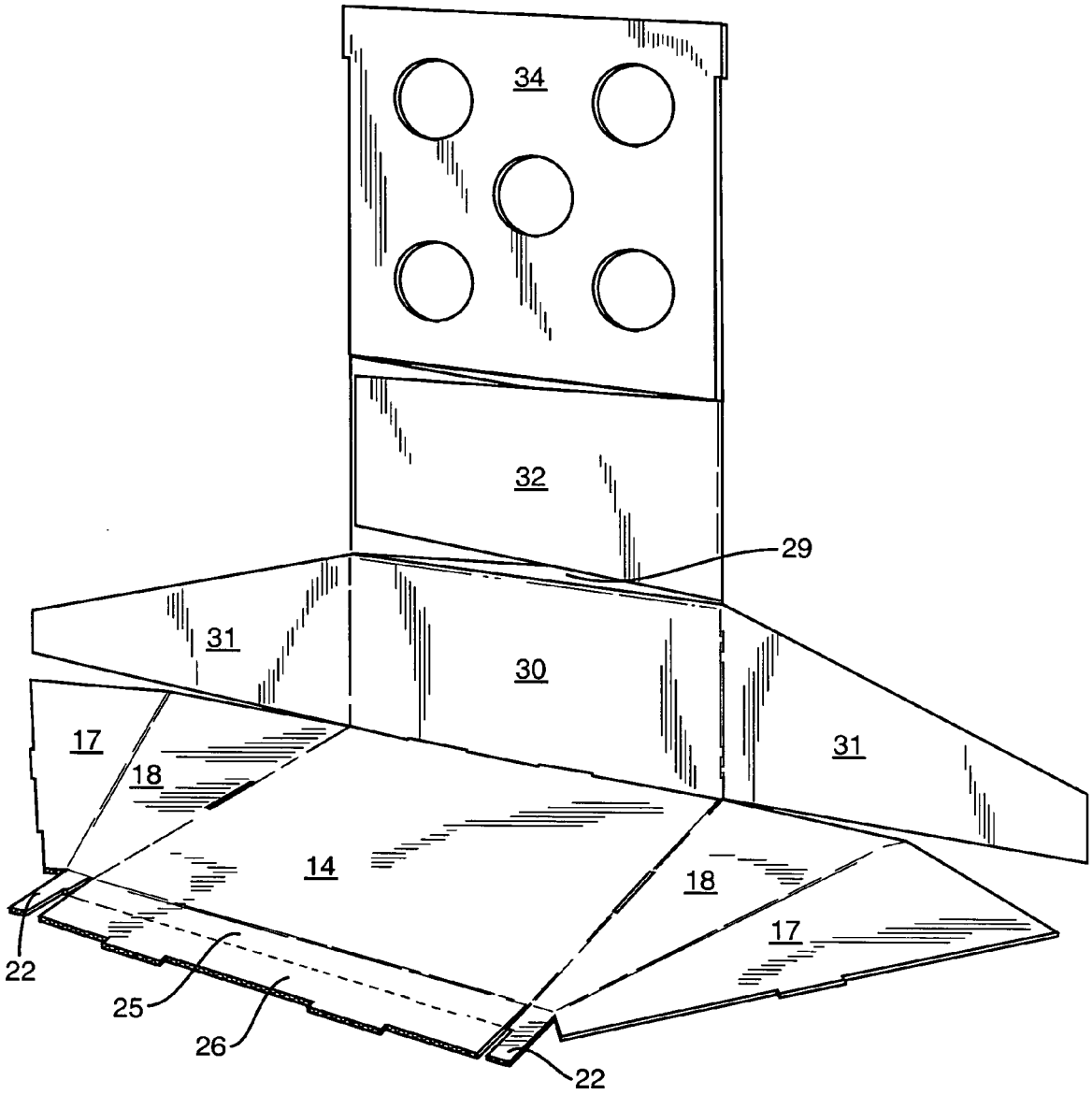
FIG. 4 is a perspective view demonstrating the folding of one embodiment.
Figure 5:
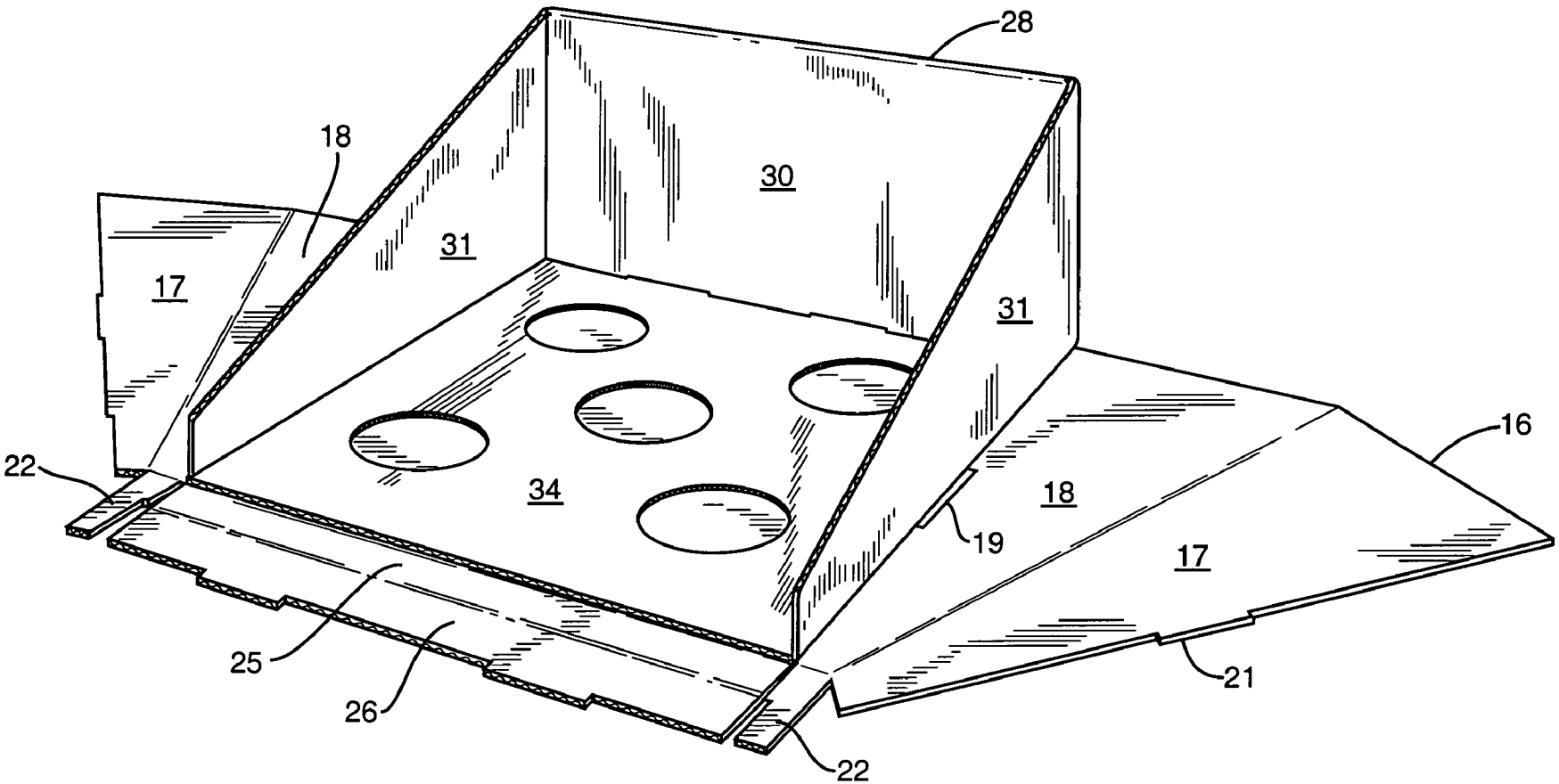
FIG. 5 is a perspective view demonstrating the folding of one embodiment.
Figure 6:
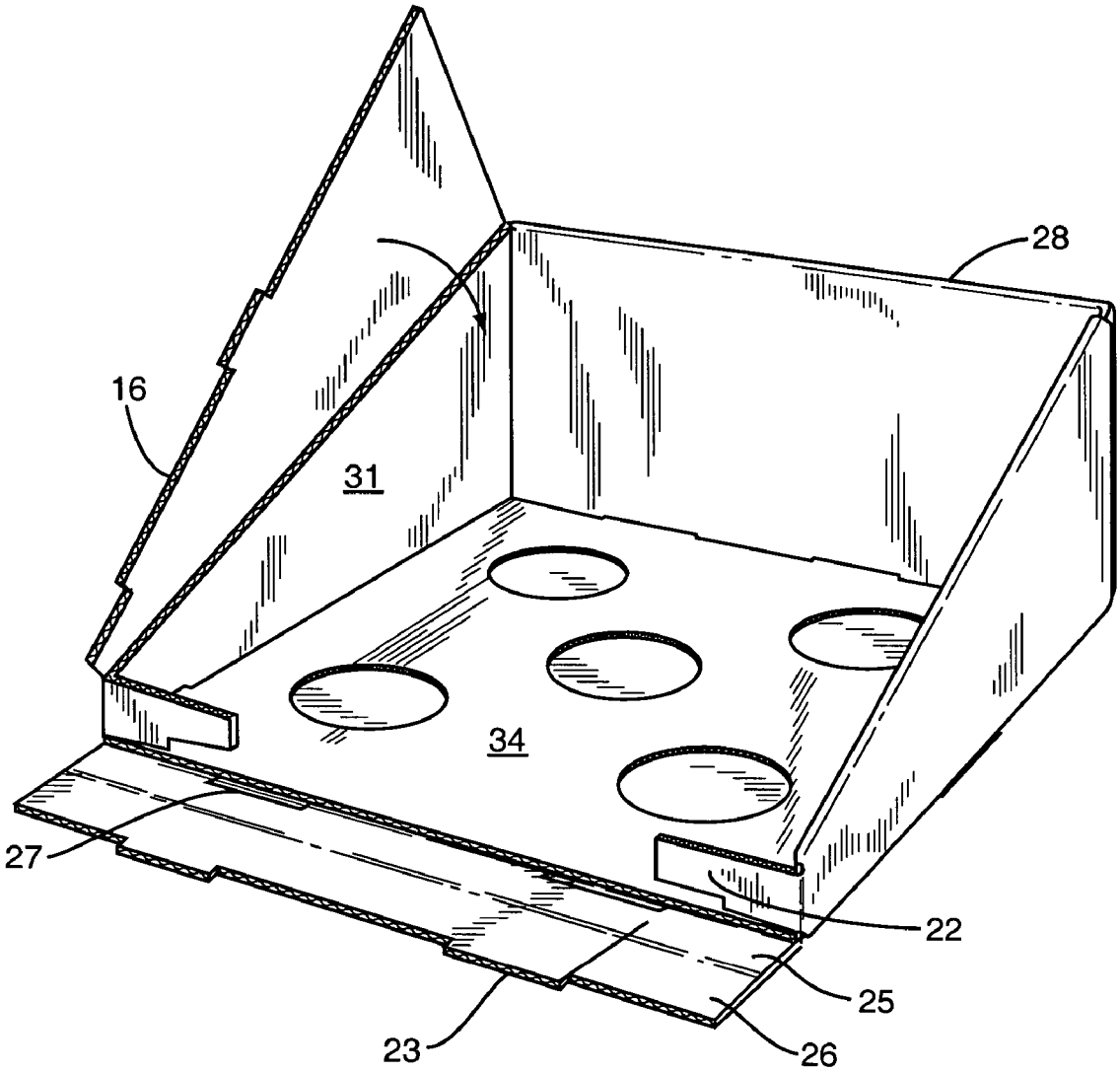
FIG. 6 is a perspective view demonstrating the folding of one embodiment.
Figure 7:
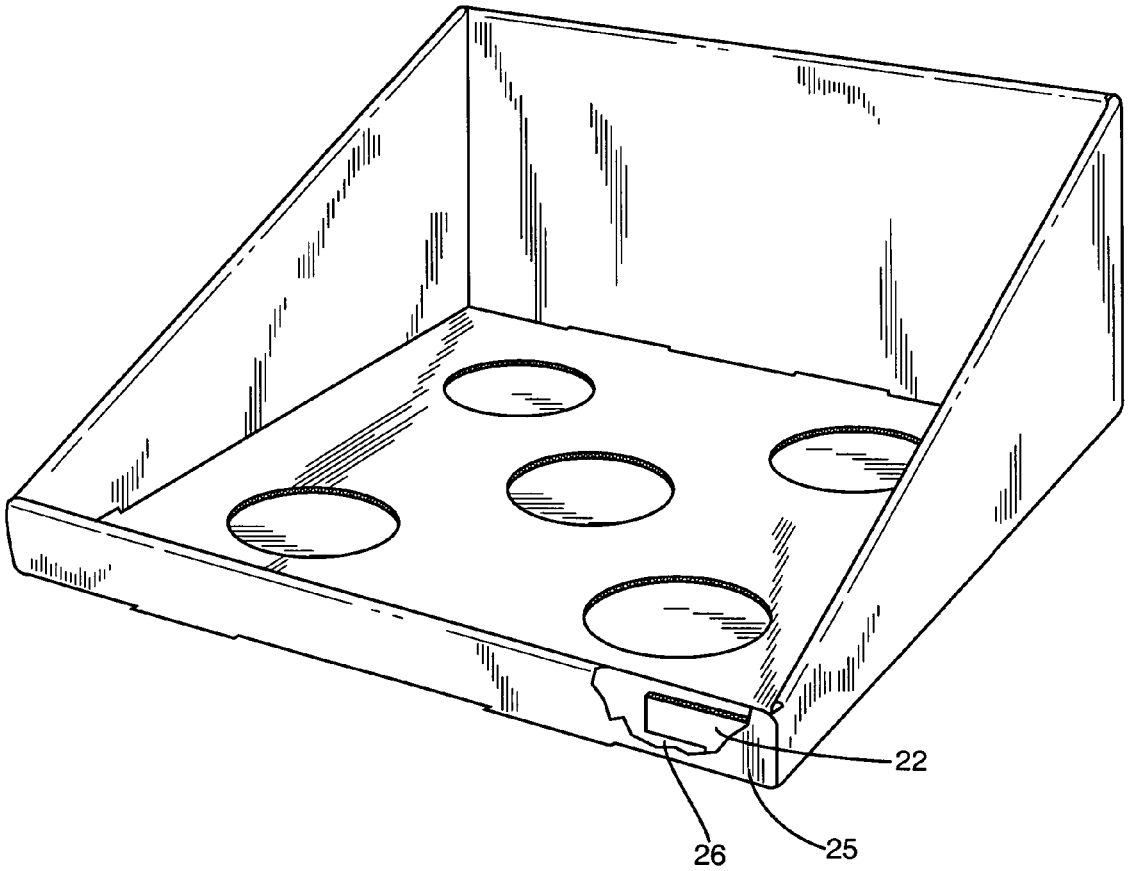
FIG. 7 is a perspective view demonstrating the folding of one embodiment.

FIGS. 4 through 7 demonstrate the steps to assemble of the target assembly 10. First, the reinforcing panels 32 on either side of the upper bottom panel layer 29 fold in as shown in FIG. 4. The upper bottom panel layer 29 then folds down against the lower bottom panel layer 30 so that the reinforcing panels 32 are sandwiched between upper bottom panel layer 29 and lower bottom panel layer 30. The back panel 34 folds in to be perpendicular to the bottom panel 28 and flat against the front panel 14 as seen in FIG. 5. The tabs 37 of bottom panel layer 29 interlock with the slots 33 to retain the bottom panel 28 in place. Next, the side flaps 31 fold inward to be perpendicular to both the bottom panel 28 and the front panel 14. The two outer side panel layers 18 fold up and the inner side panel layers 17 fold over the side flaps 31 as shown in FIG. 6. The side flaps 31 interlock the bottom panel 28 and side panel 16 perpendicular to both the bottom panel 28 and the front panel 14. The locking tabs 21 attached to the inner side panel layers 17 engage the slots 19 on either side of the front panel 14. The flaps 22, attached to the side panels 16, fold in to be perpendicular to the side panels 16 as shown in FIG. 6. The upper top panel layer 25 folds up and the lower top panel layer 26 folds over the flaps 22, sandwiching the flaps 22 as shown in FIG. 7. Two locking tabs 23 attached to the lower top panel layer 26 engage the slots 27 as shown in FIG. 6.

Figure 8A:
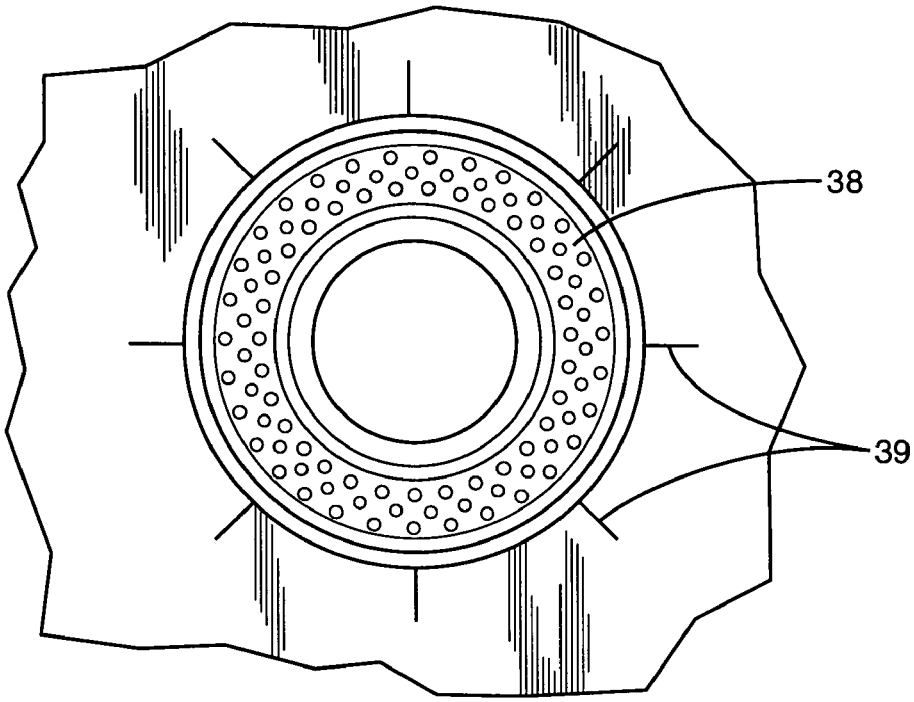
FIG. 8A is a detail view of the cutout in one exemplary embodiment.
Figure 8B:
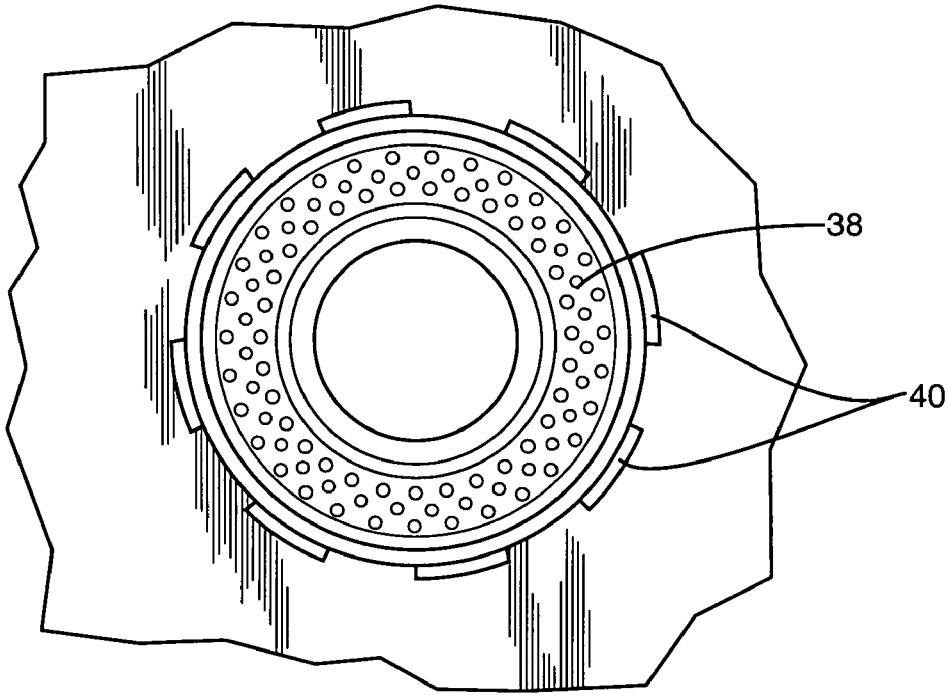
FIG. 8B is a detail view of the cutout in one exemplary embodiment.

FIGS. 8A and 8B are detail views showing various configurations of the cutouts 31 on the back panel 34. FIG. 8A shows the cutout 35 as being surrounded by a plurality of slits 39. FIG. 8B shows the cutout 35 as being surrounded by a plurality of spaced-apart tabs 40. The slits 39 and tabs 40 enable clay targets 38 to be more easily inserted.

Figure 9:
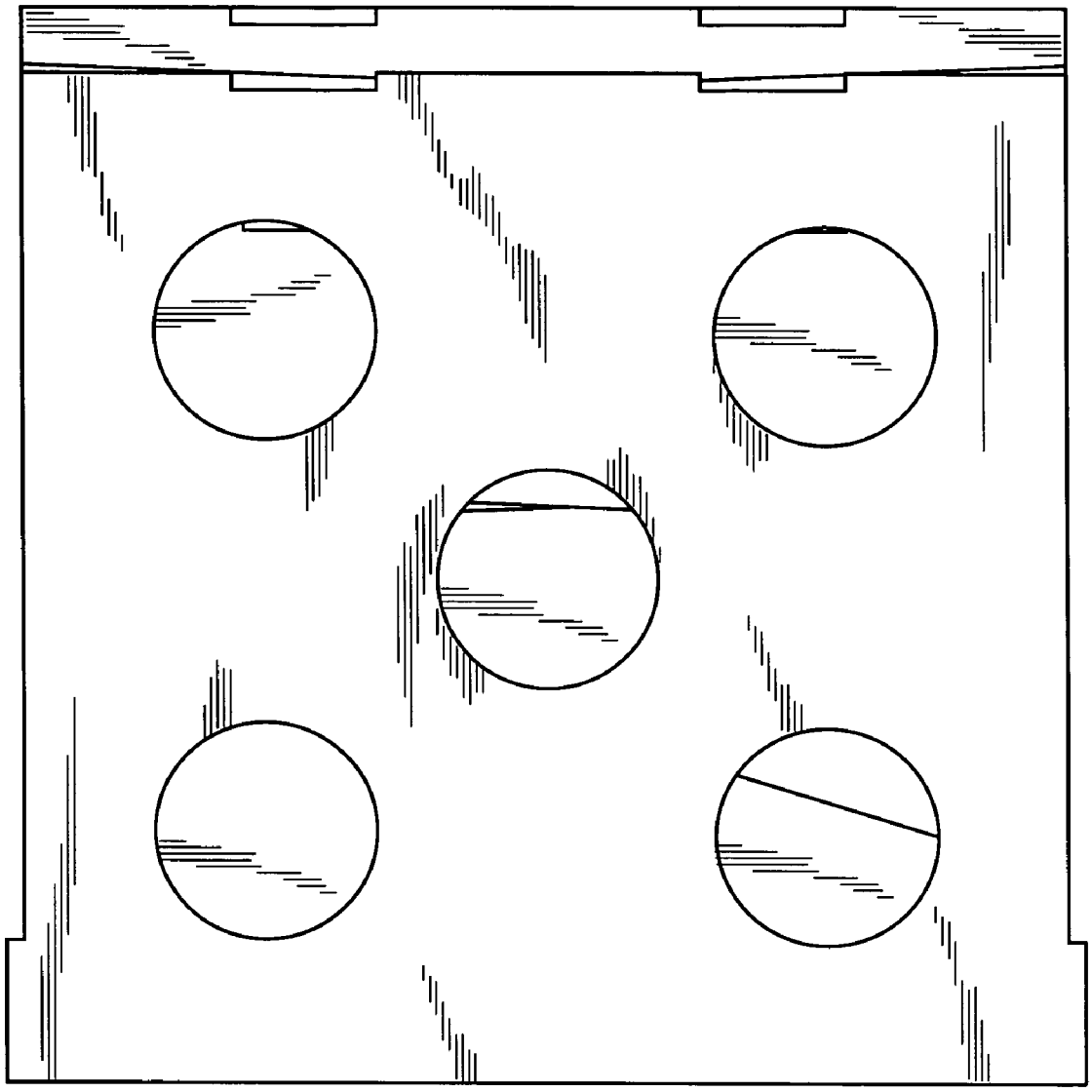
FIG. 9 is a view of one exemplary embodiment compactly folded.

Target assembly 10 of the present invention has numerous advantages. It is designed for portability and simplicity. As shown in FIG. 9, it can be folded into a compact unit and is easy to erect.

Moreover, the ability of target assembly 10 to hold clay targets 38 provides a distinct advantage to particularly good marksmen. Hitting a clay target 38 sends a puff of dust that is visible from a great distance. By hitting a clay target 38, the marksman would definitively know he hit the target and would move to another target or insert a new clay target 38 into the empty cutout 35.

The present invention may, of course, be carried out in other ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A target assembly comprising a. a support member having one or more cutouts to frictionally hold clay targets;

b. a plurality of tabs circumferentially spaced around the cutouts to frictionally engage the periphery of the clay targets; and c. one or more clay targets insertable into the cutouts.

2. A target assembly comprising a. a planar support member having a front side and a back side;

b. a printed target disposed on the front side;

c. one or more cutouts disposed on the back side for frictionally holding clay targets; and d. one or more clay targets insertable into the cutouts.

3. The target assembly of claim 2 wherein the planar member has a plurality of slits surrounding the periphery of the cutouts.

4. The target assembly of claim 2 wherein the planar member has a plurality of tabs adjacent to the cutouts to frictionally engage the periphery of the clay targets.

5. The target assembly of claim 2 wherein the planar member has a plurality of tabs circumferentially spaced around the cutouts to frictionally engage the periphery of the clay targets.

6. The target assembly of claim 2 wherein said support member is self-supporting.

7. The target assembly of claim 2 wherein said support member is collapsible.

8. A target assembly comprising a. a front panel b. two side panels connected to opposing sides of the front panel;

c. a top panel connected to the top of the front panel;

d. a back panel that folds in to be aligned with the front panel;

e. said back panel having one or more cutouts to frictionally hold clay targets;

f. a bottom panel connected to the front panel;

g. said bottom panel comprising upper and lower bottom panel layers; and h. one or more clay targets insertable into the cutouts.

9. The target assembly of claim 8 wherein the side panels each comprise an inner and outer side panel layers that fold in to be perpendicular to the front panel.

10. The target assembly of claim 8 wherein the top panel comprises an upper and lower top panel flap that fold in to be perpendicular to the front panel.

11. The target assembly of claim 8 wherein two tabs interlock with the top panel.

12. The target assembly of claim 8 wherein two tabs interlock with the side panels.

13. The target assembly of claim 8 wherein two side flaps interlock with the side panels.

14. The target assembly of claim 8 wherein two side flaps interlock with the bottom panel.

15. The target assembly of claim 8 wherein one or two reinforcing panels interlock with the bottom panel.

16. The target assembly of claim 8 wherein a printed target is disposed on the front panel.

17. The target assembly of claim 8 wherein the back panel has a plurality of slits surrounding the periphery of the cutouts.

18. The target assembly of claim 8 wherein the back panel has a plurality of tabs circumferentially spaced around the cutouts to frictionally engage the periphery of the clay targets.

19. The target assembly of claim 8 wherein said assembly is collapsible.

20. The target assembly of claim 8 wherein the entire assembly is cut from one sheet of corrugated cardboard or other material.

21. The target assembly of claim 8 wherein the bottom panel is deep enough, when the assembly is erected, to hold a weight and provide enough support to keep the erected system from falling over easily during use.

* * * * *